United States Patent [19]

Webb

[11] Patent Number: 4,990,345

[45] Date of Patent: Feb. 5, 1991

[54] PACKAGE WITH COMPARTMENTED CLOSURE ASSEMBLY

[76] Inventor: John D. Webb, 2101 Victoria Dr., Clearwater, Fla. 34623

[21] Appl. No.: 279,497

[22] Filed: Dec. 5, 1988

[51] Int. Cl.[5] ..... B65D 51/20; B65D 50/00; B65D 43/14; B65D 21/00

[52] U.S. Cl. ..... 426/123; 220/256; 220/259; 220/212; 229/522; 229/1.5 C; 229/906; 229/DIG. 13; 206/509; 206/633; 206/631.1; 206/205; 206/807; 426/112; 426/115; 426/124; 426/396; 426/397; 426/398; 426/404; 53/432; 53/433

[58] Field of Search ..... 426/115, 124, 123, 112; 220/23, 212, 256, 257, 258, 259; 229/1.5 C, 1.5 B, 906, DIG. 13; 206/509, 633, 631.1, 631

[56] References Cited

U.S. PATENT DOCUMENTS

| | | | |
|---|---|---|---|
| 1,257,057 | 2/1918 | White | 229/1.5 C |
| 1,514,379 | 11/1924 | Fleischer | 229/1.5 C |
| 2,207,520 | 7/1940 | Rhody | 229/1.5 C |
| 3,158,491 | 11/1964 | Farrell et al. | 426/123 |
| 3,173,581 | 3/1965 | Pel | 206/509 |
| 3,344,974 | 10/1967 | Bostrom | 220/257 |
| 3,389,830 | 6/1968 | Smith | 206/509 |
| 3,394,861 | 7/1968 | Truax | 220/256 |
| 3,467,244 | 9/1969 | Mahaffy et al. | 426/111 |
| 3,514,029 | 5/1970 | Powell | 206/217 |
| 3,552,634 | 1/1971 | Ollier et al. | 220/257 |
| 3,561,668 | 2/1971 | Bergstrom | 220/258 |
| 3,624,787 | 11/1971 | Newman | 220/257 |
| 3,679,093 | 7/1972 | Chang | 220/23 |
| 3,782,602 | 1/1974 | Page | 206/509 |
| 3,885,731 | 5/1975 | Mullinix et al. | 426/123 |
| 3,893,566 | 7/1975 | Ross | 220/259 |
| 4,040,561 | 8/1977 | Philipport | 220/259 |
| 4,055,671 | 10/1977 | Mahaffy et al. | 426/123 |
| 4,101,047 | 7/1978 | Geppert et al. | 220/258 |
| 4,103,802 | 8/1978 | Piltz et al. | 220/258 |
| 4,300,700 | 11/1981 | Chang | 220/23 |
| 4,340,138 | 7/1982 | Bernhardt | 220/23 |
| 4,346,833 | 8/1982 | Bernhardt | 220/257 |
| 4,401,229 | 8/1983 | Bell et al. | 220/259 |
| 4,473,168 | 9/1984 | Cox | 220/258 |
| 4,685,582 | 8/1987 | Pulciani et al. | 206/509 |
| 4,738,374 | 4/1988 | Ingemann | 220/258 |

FOREIGN PATENT DOCUMENTS

| | | | |
|---|---|---|---|
| 0001460 | 4/1979 | European Pat. Off. | 426/124 |
| 6615638 | 5/1967 | Netherlands | 220/256 |

OTHER PUBLICATIONS

Sustrelle Lab. Manual 6/2/75.

*Primary Examiner*—Steven Weinstein
*Attorney, Agent, or Firm*—Dominik, Stein, Saccocio, Reese, Colitz & Van Der Wall

[57] ABSTRACT

A container for the storing and the direct consumption of edible contents therefrom. The container comprises a substantially cylindrically shaped container defined by an upstanding sidewall and an upper lid and a substantially parallel lower closure. The container also comprises a cover removably mounted above the upper lid to define a space between the upper lid and the cover. A utensil is located within the space for consuming the edible contents within the container. The container further comprises means between the upper lid and the cover for emitting a fragrance upon the separation of the cover from the upper lid. One of the lids and the sidewall thereadjacent is constricted to a reduced size for being inserted into the opposite end of another container for stacking purposes. The package is tamper evident with its upper lid coupled with respect to the sidewall so as to preclude littering. Lastly, also disclosed are methods of fabricating, filling and using such containers.

4 Claims, 7 Drawing Sheets

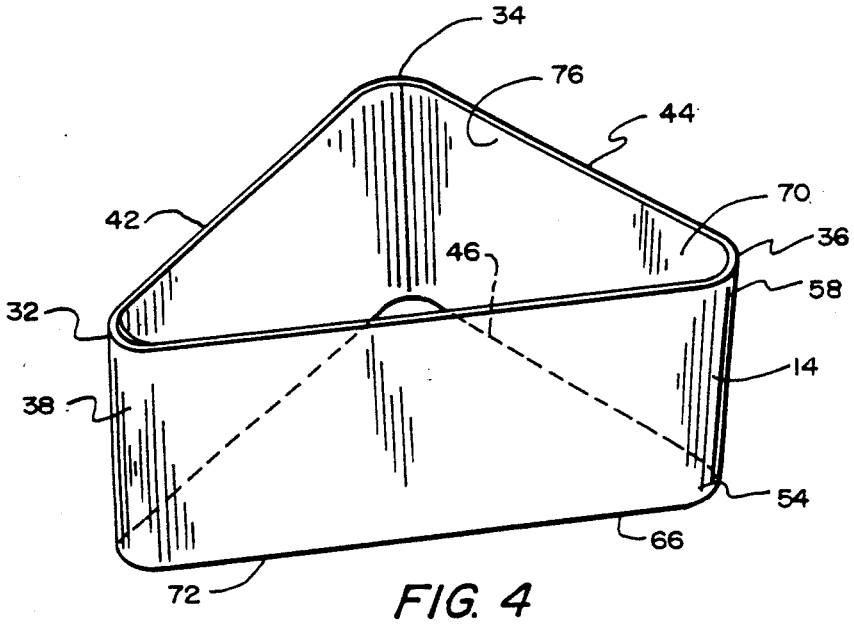
FIG. 4
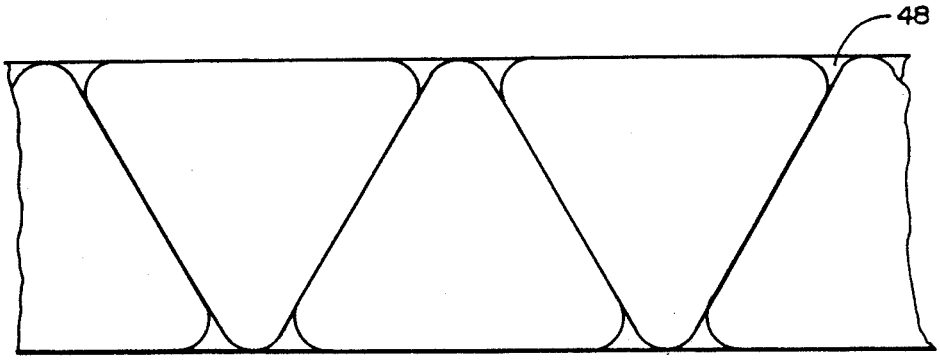
FIG. 5
FIG. 6
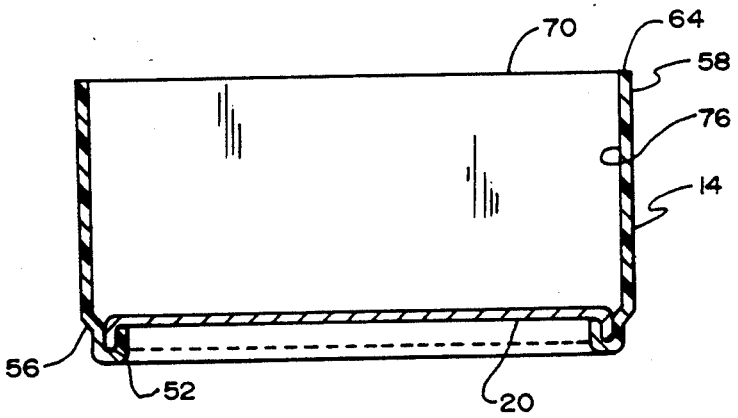
FIG. 7
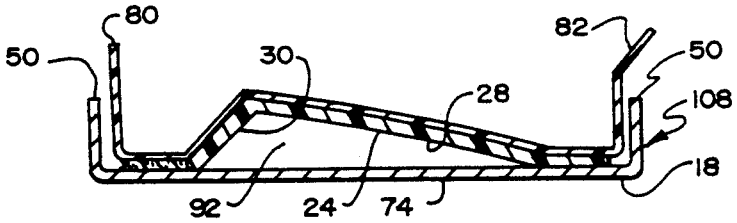

PACKAGE WITH COMPARTMENTED CLOSURE ASSEMBLY

FIELD OF THE INVENTION

The present invention relates to containers with edible contents and, more particularly, to a package including a container, an eating utensil and edible contents. The package enhances the fragrance of the edible contents, precludes littering upon opening of the container for consumption of the contents, is tamper evident, and allows for the stackablity of the containers. The present invention also relates to methods of fabricating, filling and using such packages and containers.

DESCRIPTION OF THE BACKGROUND ART

In designing an optimum package for the marketing of edible contents, particularly at the consumer level, there are a number of desirable features which should be present. For example, a package should have a relatively long shelf life and require a minimum footprint on a given shelf. In the event that chilled edible contents are to be packaged and consumed therefrom, the package should have good insulating characteristics to insure that the edible contents maintain their chilled condition for a proper time interval. The making of the package most desirably involves an efficient utilization of raw material so as to minimize waste. Also, if possible, the package should have a distinctive visual characteristic such as shape so that it is easily recognizable by the consumer as emanating from a particular source or origin. If possible, the positioning of the package on a shelf should be rendered relatively unimportant by providing a configuration such that the identification of the goods based upon the labeling or printing on the exterior on the package is readily visible regardless of the positioning of the package on the shelf. If the application of labels can be eliminated, the cost of the package can be reduced. In addition, the container should by tamper evident, particularly if it is to contain contents which are to be consumed. Further, if the package has associated therewith an eating utensil for the purpose of such consumption, the package must be effective to maintain the sterility of the eating utensil as well as the associated contents and container parts during package fabrication, filling, shipment and storage. Still further, because some frozen or chilled edible contents offer less flavor and aroma than some which are adapted to be served at room temperature, a package which can actually enhance the fragrance of the packaged edible contents is highly desirable. Additionally, stackablity and versatility of the package in adapting to multiple package configurations is important so as to reduce the volume taken up by large numbers of these packages to save space and shipping costs as well as providing multiple package configurations for both sale and display which would appeal to the consumer or buyer. The package should have a cover and a lid coupled with respect to the remainder of the package so that when the package is opened to expose the contents for consumption the cover and lid will remain attached to the remainder of the package to preclude littering.

In addition to the container per se and its design, a preferred container should be readily adapted for convenient fabrication, filling and use.

While progress has been made in improving containers, problems still persist in their design as well as in their methods of fabrication, filling and use. Many approaches are disclosed in the literature to minimize the existing problems associated with containers.

A wide variety of packages are disclosed in the patent literature. Note, for example, U.S. Pat. Nos. D-57,707 to Morrison; 2,315,116 to Flizikowski; 3,118,533 to Curtis; 3,141,598 to Rasmussen et al; 3,222,190 to Davis and 3,254,434 to Gintoft.

In addition, the patent literature also discloses a wide variety of containers with utensils associated therewith. Note, for example, U.S. Pat. Nos. 1,257,057 to White; 1,749,658 to Ault; 1,607,865 to Butler; 2,525,337 to Brooks et al; 2,584,379 to Chmielewski and 2,745,586 to Thoma. The patent literature also discloses a wide variety of the packaging features such as for the release of perfume or other volatile substances. Note, for example, U.S. Pat. Nos. 2,335,159 to Salfisberg; 2,543,181 to Land; 2,907,682 to Eichel; 2,932,582 to Pesa et al; 3,441,353 to Claff; 3,599,859 to Maierson; 3,685,734 to Paciorek et al; 3,779,848 to Maierson; 4,145,001 to Weyenberg; 4,419,396 to Sugimoto; 4,474,304 to Jacobs and 4,487,801 to Turnbull et al.

Lastly, U.S. Pat. No. 4,589,264 to Astrom relates to a package treating system.

Although many such advances are noteworthy to one extent or another none achieves the objectives of an efficient, convenient and inexpensive package which includes a container and edible contents in association with an eating utensil along with the related methods of fabrication, filling and use. An optimum package would be something new which combines the benefits of the prior art approaches without their shortcomings.

As illustrated by the great number of prior patents as well as commercial packages, efforts are continuously being made in an attempt to improve packages and render them more efficient, convenient and economical. None of these prior efforts, however, provides the benefits attendant with the present invention. Additionally, the prior packages do not suggest the present inventive combination of component elements and method steps as disclosed and claimed herein. The present invention achieves its intended purposes, objectives and advantages over the prior art through a new, useful and unobvious combination of component elements and method steps, with the use of the minimum number of functioning parts and process steps, at a reasonable cost and convenience to manufacture and use, and by employing only readily available material.

Therefore, it is an object of the present invention to provide an improved package for the storing and the direct consumption of edible contents therefrom which comprises a substantially cylindrically shaped container defined by an upstanding sidewall, a separate upper lid and an essentially parallel lower closure; a cover separately mounted above the upper lid to define a space between the upper lid and the cover; and a utensil within the space for use in the consuming of the edible contents stored within the container.

It is a further object of the present invention to enhance the fragrance of the edible contents of a container.

It is yet a further object of the invention to render a package of edible contents tamper evident.

Yet another object of the present invention is to improve the stackablity of containers.

Still a further object of the present invention is to preclude littering upon the opening of the lid of a container for the consumption of the contents of the container.

Lastly, it is an object of the invention to improve the methods of fabrication, filling and using containers of edible contents.

The foregoing has outlined some of the more pertinent objects of the invention. These objects should be construed as merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiments in addition to the scope of the invention as defined by the claims taken in conjunction with the accompanying drawings.

SUMMARY OF THE INVENTION

The invention is defined by the appended claims with the specific embodiments shown in the attached drawings. For the purposes of summarizing the invention, the invention may be incorporated into a container for the storing and the direct consumption of edible contents therefrom. The container is of a substantially cylindrically shape and is defined by an upstanding sidewall, a separate upper lid and an essentially parallel lower closure. A cover is separably mounted above the upper lid to define a space between the upper lid and the cover. A utensil is provided within the space for use in the consuming of the edible contents stored within the container. The container further includes means between the upper lid and the cover for emitting a fragrance upon the separation of the cover from the upper lid. The upper lid is coupled with respect to the sidewall adjacent thereto allowing for the easy separation of the upper lid with respect to the sidewall adjacent thereto over a major portion of the extent of their coupling. The upper lid is coupled with respect to the sidewall adjacent thereto for prohibiting the easy separation of the upper lid with respect to the sidewall adjacent thereto over the remaining minor portion of the extent of their coupling thereby precluding total separation of the upper lid from the sidewall during use. The upper lid is bonded to the upper edge of the sidewall with an adhesive extending around the entire periphery of the upper lid bonding tamper evident. The sidewall adjacent one end thereof is constricted to a reduced size for being inserted within the opposite end of another container.

The invention may also be incorporated into a package, including a container and contents, for the storing and the direct consumption of edible contents therefrom. The package comprises a substantially cylindrically shaped container defined by an upstanding sidewall and a separable upper lid and an essentially parallel lower closure. A cover is separably mounted above the upper lid to define a space between the upper lid and the cover. A utensil is provided within the space for use in the consuming of the edible contents stored within the container. Means are provided between the upper lid and the cover for emitting a fragrance upon the separation of the cover from the upper lid. The sidewall adjacent one end thereof is constricted to a reduced size for being inserted with the opposite end thereof for the stacking of another container therewith. The upper lid is coupled with respect to the sidewall adjacent thereto allowing for the easy separation of the upper lid with respect to the sidewall adjacent thereto over a major portion of the extent of their coupling. The upper lid is coupled with respect to the sidewall adjacent thereto for prohibiting the easy separation of the upper lid with respect to the sidewall adjacent thereto over the remaining minor portion of the extent of their coupling thereby precluding total separation of the upper lid from the sidewall during use. The upper lid is bonded to the upper edge of the sidewall with an adhesive extending around the entire periphery of the upper lid and sidewall to render such area of bonding tamper evident.

The invention may also be incorporated into a method of making a sealed container for edible contents. The method comprises the steps of: (1) forming a sidewall from sidewall material by shaping such material into an essentially cylindrical configuration axially bounded by a top opening and a bottom opening; (2) forming an assembly of an upper lid and cover and then sealing the periphery of the assembly to the periphery of the sidewall for covering the upper opening; (3) forming a lower lid positionable to cover the lower opening; (4) with the sidewall inverted, filling the space between the sidewall and upper cover with edible contents; and (5) sealing the periphery of the lower cover with the periphery of the sidewall for covering the lower opening and thereby sealing the edible contents within the container defined by the sidewall, lower lid and upper lid.

In addition, the invention may be incorporated into a method of creating a sealed package consisting of a container and edible contents within such container. The method comprises the steps of shaping material into a sidewall of a generally cylindrical configuration having a contents-containing space extending therethrough between an upper opening and a lower opening and sealing an upper lid into the upper opening. With the sidewall inverted, the further steps include prefilling the space between the sidewall and upper lid with fluid and solid edible contents; inserting nozzle half means into the package with a longer nozzle half extending into the fluid and with a shorter nozzle half extending essentially to the intended elevational level of a lower lid; positioning a lower lid over the lower opening with the periphery of the lower lid in contact with the periphery of the sidewall except in a nozzle area whereat the nozzle half means is located; and injecting fluid through the longer nozzle half to bring the prefill level of liquid up to the shorter nozzle half and lower lid to thereby remove all bubbles and voids. The method includes the additional steps of removing the nozzle half means and sealing the lower cover and sidewall at the nozzle area thereby providing a void free package formed of a container and its contents, the container being defined by the sidewall, upper lid and lower lid.

Lastly, the invention may be incorporated into a method of opening a package formed of a container and edible contents within such container, such container comprising a substantially cylindrical shaped sidewall and an upper lid and a substantially parallel lower closure, a cover removably mounted above the upper lid to define a space between the upper lid and the cover and a utensil within the space for use in consuming the edible contents within the container. Such method comprises the steps of separating the cover from a portion of the package; removing the utensil from the remainder of the package; pulling a portion of the upper lid away from the remainder of the package to expose the contents of the package; and terminating the pulling when greater resistance to the pulling is met whereby the contents will be essentially completely exposed but a portion of the upper lid will remain coupled with the sidewall for the precluding of littering.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as the basis for modifying or designing other methods and structures for carrying out the same purposes of the present invention. It should also be realized by those skilled in the art that the equivalent method steps and constructions do not depart from the spirit and scope of the invention as set forth in the appended claims.

BRIEF DESCRIPTION OF THE DRAWINGS

For a further understanding of the nature and objects of the invention reference should be had to the following detailed description, when considered in conjunction with the accompanying drawings in which like reference numerals designate like parts throughout the FIGS. thereof, and wherein:

FIG. 4 is a perspective illustration showing assembled sidewall of the wedge shaped container;

FIG. 5 is a top plan view illustrating the formation of the upper lid and bottom lid of the present invention cut from a common rectangular sheet of material to minimize scrap;

FIG. 6 is a diagrammatic cross sectional view through the center portion of the container of FIG. 4 illustrating the configuration of the bottom closure or lid after insertion into and bonding to the sidewall portion of the container;

FIG. 7 is a diagrammatic cross sectional view of the upper cover-lid assembly of the present invention prior to the application thereof to the container;

DETAILED DESCRIPTION OF THE INVENTION

Figure 1:
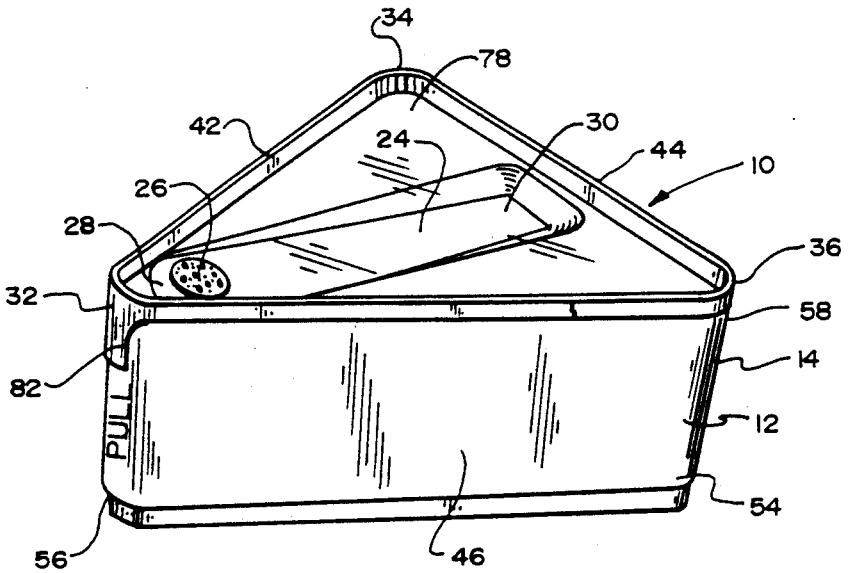
FIG. 1 is a top perspective illustration of a flat wedge shaped package of the present invention.
Figure 2:
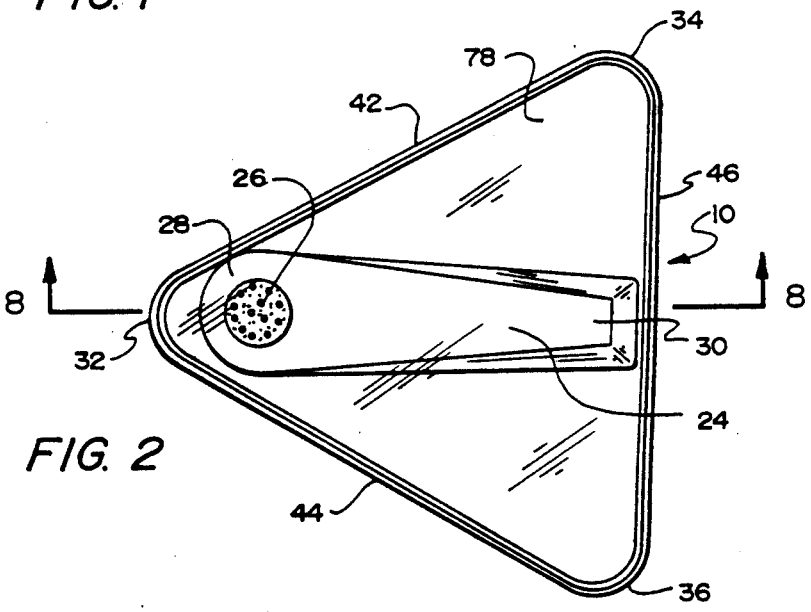
FIG. 2 is a top plan view of an assembled wedge shaped package as shown in FIG. 1.
Figure 3:
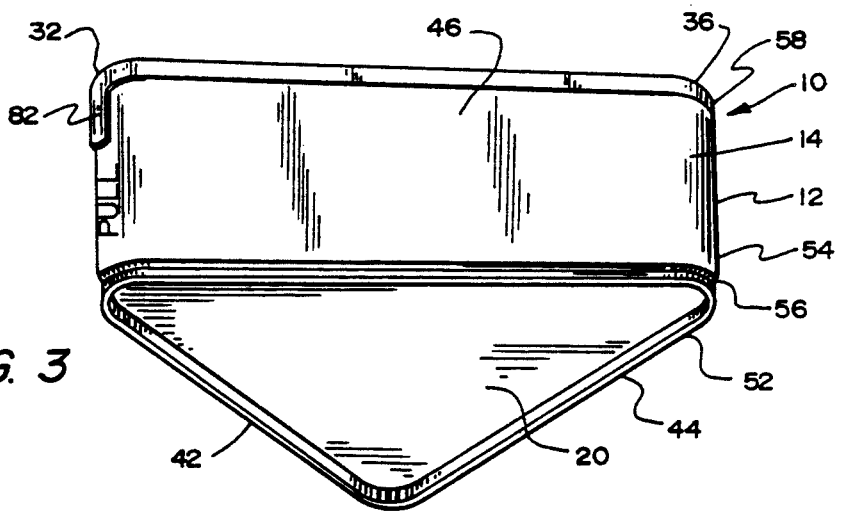
FIG. 3 is a bottom perspective illustration of the wedge shaped package of FIGS. 1 and 2.

Referring in detail to the drawings, and with particular reference to FIGS. 1, 2 and 3, the wedge shaped package 10 of the present invention is illustrated as including a container 12 formed by a generally cylindrical sidewall 14 of triangular cross section and its contents 16. The container 12, in addition to the sidewall 14, includes an upper lid 18 and a lower lid or closure 20.

As further shown in FIGS. 1 and 2, a utensil 24, illustrated in the form of a spoon 24 or the like, is provided for assisting in eating the contents 16 of the container 12 once it has been opened.

Also, as illustrated in FIGS. 1 and 2, a fragrance emitting material 26 is provided on the shank 28 or gripping portion of the spoon 24, the end opposite the bowl end 30, to emit fragrance in a selective manner as will hereinafter be more fully described.

As illustrated in FIG. 4, the sidewall 14 may be fabricated from a single elongated rectangular blank which is formed with three pointed areas 32, 34 and 36, with a lap joint 38 formed in front pointed area or corner 32 thereof. The sides 42, 44 and 46 have no such lap joint. The lap joint is preferably made at a corner for maximum strength. Further, a lap joint on a side would interfere with efficient printing or graphics on the side with such lap joint, an undesirable situation.

Referring to FIG. 5, the preferred embodiments of the present invention utilizes triangular closure blanks or lids 18 and 20 cut from a single piece of rectangular stock 48 in the form of blanks or lids to minimize scrap. These triangular blanks are provided with annular flanges 50 and 52 on the lower cover portion such as those illustrated in FIG. 6. The upper lid 18 is further illustrated in FIG. 7 and is shown as including upturned annular flanges 50.

As further illustrated in FIG. 6, and as shown in FIGS. 1, 3, 10 and 11, the lowermost region 54 of the sidewall 14 is provided with an inward taper 56 towards the bottom thereof to thereby form an annular tapered portion 56 such that the lowermost region or section 54 of one container 12 may be received and nest within the uppermost region 58 of another container for accommodating a stacked array of packages. Such a stacked array of containers may be shrink wrapped as a group for merchandising purposes or they may simply be stacked, one upon another, to conserve shelf space.

Further, as illustrated in FIG. 6, the sidewall 14 is turned inward beneath the lower annular flange 52 to thereby provide a bottom curl 60 to seal the lowermost edges of the container 12. When bonded with an adhesive 62, this construction maintains a strong bottom which enhances sanitation and precludes wicking of moisture and leakage by the lowermost edges of the package 10.

Figure 8:
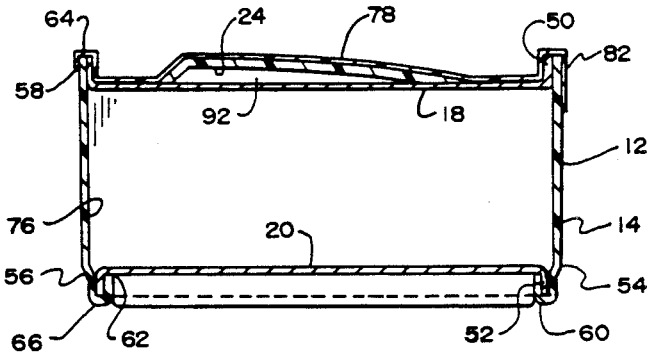
FIG. 8 is a cross sectional view of a fully assembled package in diagrammatic form taken along line 8—8 of FIG. 2.

Referring next to FIGS. 7 and 8 it can be seen that both the flanges 50 and 52 of the upper and lower lids 18 and 20 of the container 12 conform to the inner surface of the triangular sidewall 14 adjacent to the upper and lower rim or edge 64 and 66 portions thereof where they are preferably bonded to their adjacent sidewall 14 by adhesive, heat sealing or the like. Thus, there are provided recessed lids or closures 18 and 20 for the container 12 for sealing the upper opening 70 and lower opening 72 of the sidewall 14.

Referring next to FIG. 7 it can be seen that the upper lid 18 includes a central portion extending completely across the upper opening 70 of the container 12. It is from the central portion 74 that the annular upturned flange 50 extends into an adhesive bonded engagement with the interior surface 76 of the adjacent sidewall 14 of the container 12 adjacent to the top rim or edge 64 of the sidewall 14. This will be more fully described in connection with FIGS. 9, 10 and 12 which illustrate in enlarged detail the interengagement of the upper lid 18 with the sidewall 14.

The upper lid 18 supports the spoon or utensil 24 together with its fragrance emitting material 26 on the central portion 74 of the upper lid 18 where the spoon 24 is held in place. The fragrance emitted from the material is basically sealed from the atmosphere by an upper cover 78. The cover 78 is preferably comprised of a clear vacuum formed plastic material which conforms to and encompasses the utensil 24. It is adhesively secured peripherally to the upper lid 18. In its initially assembled state, the upper cover 78 is provided with an upturned annular flange 80 on the cover 78 which includes an upstanding pull tab 82 positioned adjacent to one pointed area 32 of the triangular sidewall 14.

Figure 10:
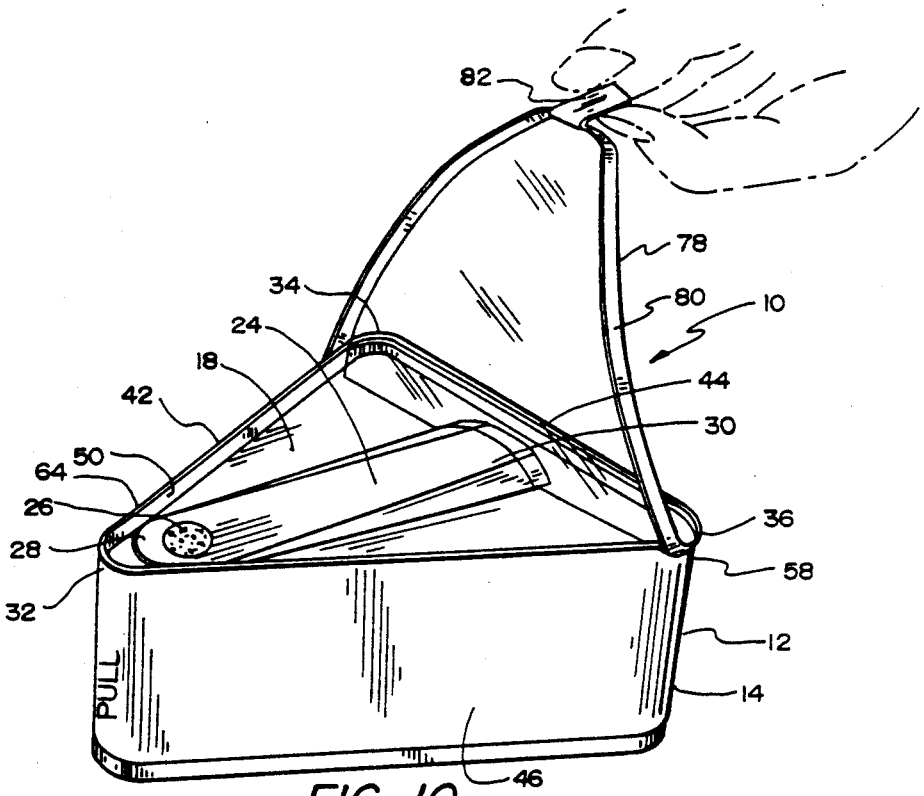
FIG. 10 is a perspective illustration showing the removal of the cover from the top lid of the container.
Figure 11:
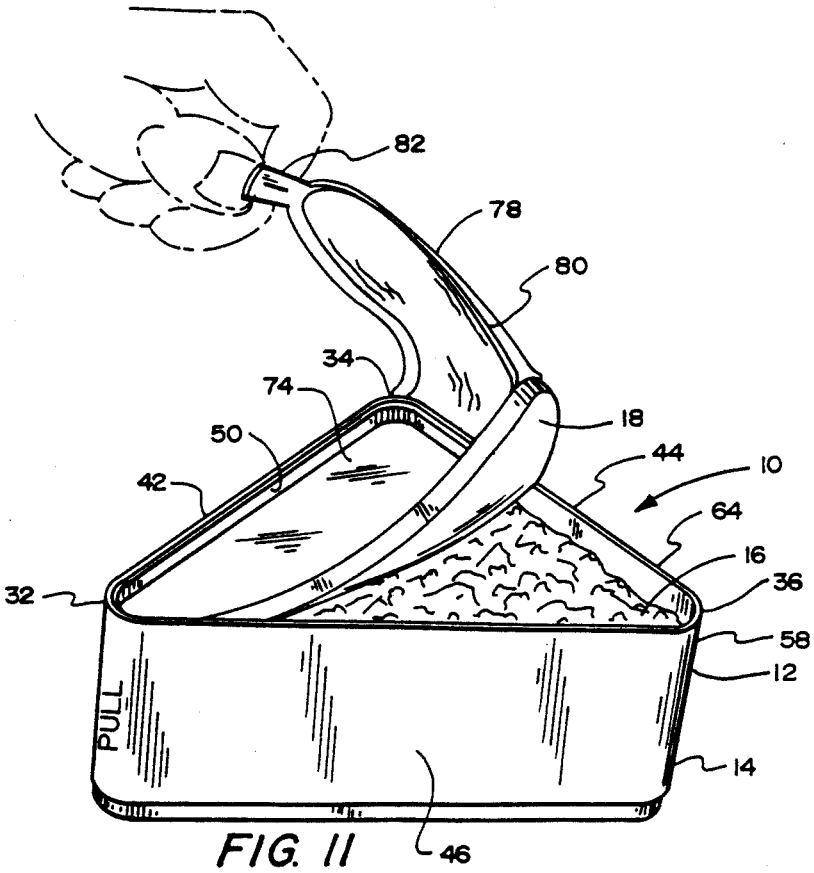
FIG. 11 illustrates the removal of the upper lid and cover from the container.
Figure 17:
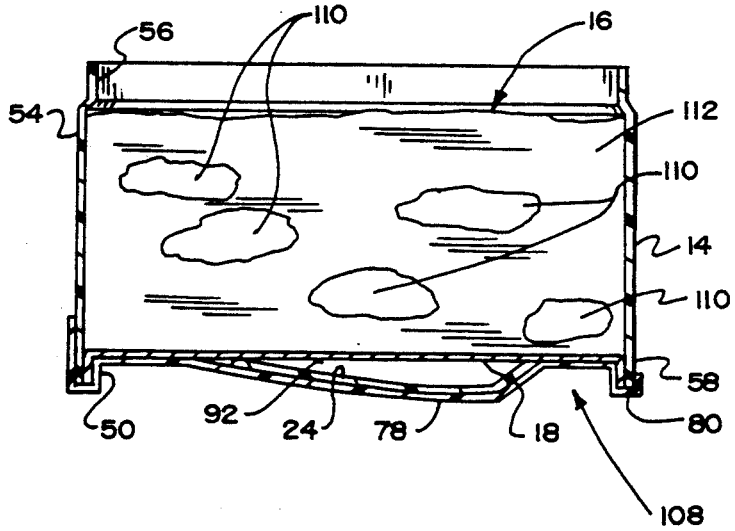

After the container 12 has been filled with suitable edible contents 16 or other substance, as illustrated in FIGS. 11 and 17, the upper lid 18 is placed within the opening of container 12. The upturned annular flange 50 on the upper lid 18 is adhesively secured peripherally to the interior of the sidewall 14 of the container 12 at the upper rim 64 thereof and the upturned flange 50 and pull tab 82 are heat formed by an conventional means to invert over the upper rim 64 of the sidewall 14 to form an inverted annular trough 84 which provides a sanitary and protective cover 78 for the exposed rim 64 portion of the sidewall 14 and the upturned annular flange 52 on the lower lid 20 of the upper lid 18. The action of bending or heat forming the upturned flange 50 on the upper lid 18 into an inverted protective trough 84 also causes the pull tab 82 to be heat formed downward over the outer surface of one of the pointed area 32 of the container 12 as clearly illustrated in FIGS. 1 and 3. A perspective illustration of the inverted annular trough 84 is also provided and may be seen in FIG. 10.

Figure 9:
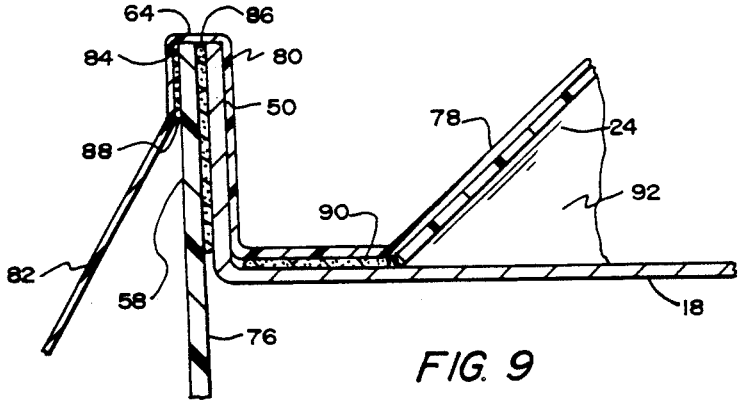
FIG. 9 is an enlarged cross sectional view of the glue joints between the cover and upper lid and the container sidewall of the present invention in a fully assembled configuration.

Referring next of FIGS. 9, 10 and 11, the details of the bond between the upper lid 18, the cover 78 and the sidewall 14 will now be described.

Components of the package are bonded together as with an adhesive to create the final assembled package, i.e., container 12 and its contents 16. As mentioned hereinabove, the interior, lower edge 66 of the sidewall 14 is bonded to the flange 52 of the lower lid 20 at their areas of mutual contact. The adhesive 62 may be applied either to the lower lid 20 or to the adjacent sidewall 14 at the time of attachment. It is preferably applied as a heat activated adhesive 62 at the time of forming the container components prior to shipment to a site for assembling the container 12 for filling it with contents 16.

In addition to the bonding with respect to the lower lid 20, a plurality of bond areas with adhesives are used for coupling the interior, upper rim 64 of the sidewall 14, the upper lid 18 and the cover 78. More specifically, the first adhesive 86 is placed between the interior, upper rim 64 of the sidewall 14 and the facing flange 50 of the upper lid 18. This adhesive 86 extends peripherally around the entire region of bonding to provide an air tight seal for protecting the contents 16 of the container 12. A small quantity of adhesive 88 is also utilized at the exterior, upper rim 64 of the sidewall 14 to hold the pull tab 82 in place prior to use. An additional ring of adhesive 90 is placed horizontally and peripherally between the cover 78 and the upper lid 18 for providing an air tight seal for the spoon 24 in the space 92 between the upper lid 18 and the cover 78.

FIGS. 10 and 11 illustrate the method of removing the spoon 24 and exposing the contents 16 of the container 12 for consumption. As can be understood from comparing FIGS. 8 and 9 with FIGS. 10 and 11, a user will grasp the pull tab 82 and pull upwardly to break the seal holding the pull tab 82 and cover 78 in place. The adhesive 90 is selected so that the bond at this area is very light. The user then continues to lift the pull tab 82 upwardly breaking the seal of adhesive 90 between the cover 78 and upper lid 18 in the area thereadjacent. Further pulling will continuously break the bond between the cover 78 and upper lid 18 at sides 42 and 46 since the adhesive 90 of the bond is relatively light. The separation and breaking of the bond continues until an area of stronger bonding is reached on that portion of the container 12 most remote from the pull tab 82, i.e., side 44. In the preferred embodiment, the entire side 44 of the container 12 remote from the initial position of the pull tab 82 is secured with a firm bond to preclude separation of the cover 78 from the upper lid 18 at this area. Adhesives are selected to effect such light and strong bonding.

The continued upward movement of the pull tab 82 will then begin to break the adhesive bond between the upper lid 18 and the sidewall 14, first at its upper edge 64 beginning at the side 44 which had been initially remote from the pull tab 82, i.e., that area whereat the cover 78 and upper lid 18 are still bonded. Separation between upper lid 18 and sidewall 14 can begin at either point 34 or 36 of the line of strong bonding between upper lid 18 and cover 78. Continued upward movement of the pull tab 82, cover 78 and upper lid 18 will sequentially pull the upper lid away from the remainder of the sidewall 14 along sides 42 and 46 to expose the contents 16 until the upper lid 18 is coupled with the sidewall 14 only in that area of upper lid 18 bonding where the pull tab 82 was initially located prior to the beginning of the opening of the container 12. This is at point 32.

The adhesive bonding of the cover 78 to the upper lid 18, the upper lid 18 to the sidewall 14, and the lower lid 20 to the sidewall 14 creates a tamper evident closure. As such, if someone were to lift the cover 78 or a lid 18 or 20, such opening action would be evident to the ultimate consumer. Most other covers or lids, particularly those of a snap-on type do not afford such tamper evident benefit.

Figure 12:
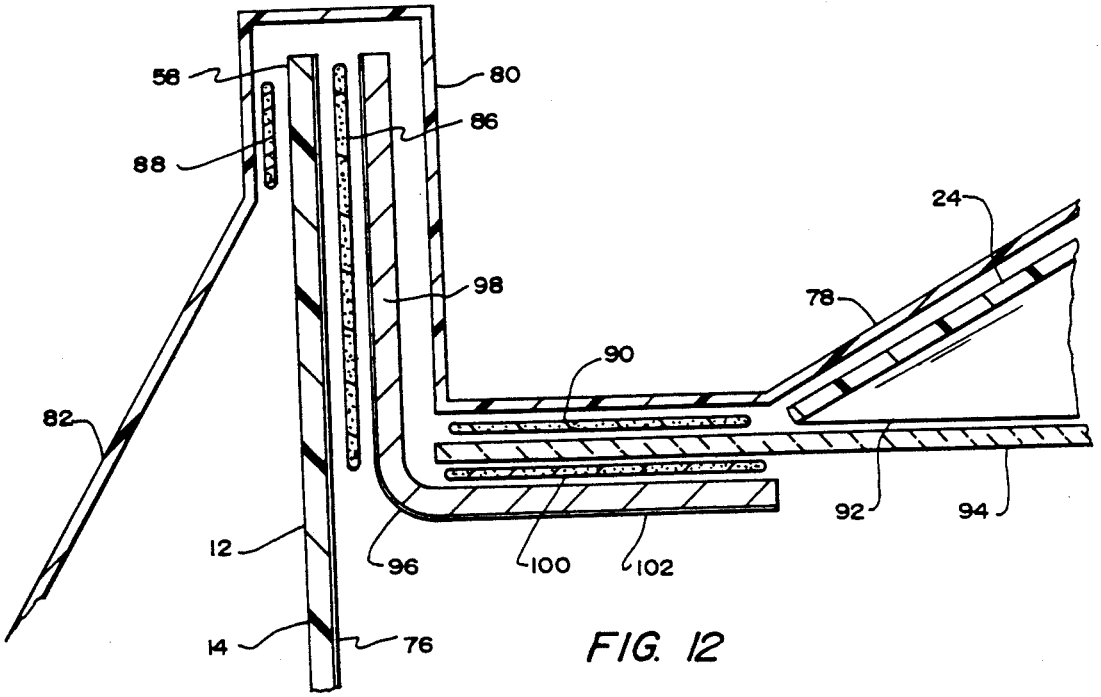
FIGS. 12 and 13 are detailed sectional views illustrating alternate embodiments for tearing away the cover and upper lid from the remainder of the container.

FIG. 12 discloses an alternate embodiment of the invention where the upper lid 18 is formed to two parts rather than one. Those two parts include a transparent section 94 in the central portion of the upper lid 18 and a peripheral, L-shaped margin 96 with an upwardly extending flange 98 extending peripherally in contact with the interior upper edge 64 of the sidewall 14. A yet additional adhesive 100 is provided between the transparent section 94 of the upper lid 18 with its peripheral portion for permanent attachment to the horizontal portion 102 of the margin 96. This embodiment allows for the visual observation of the package prior to its opening. All other features of this embodiment are identical with the primary embodiments as discussed herein.

Figure 13:
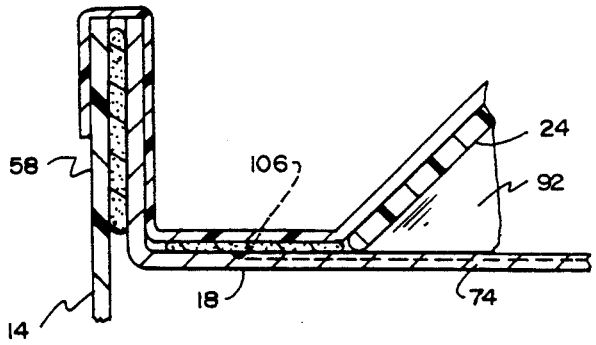
Figure 14:
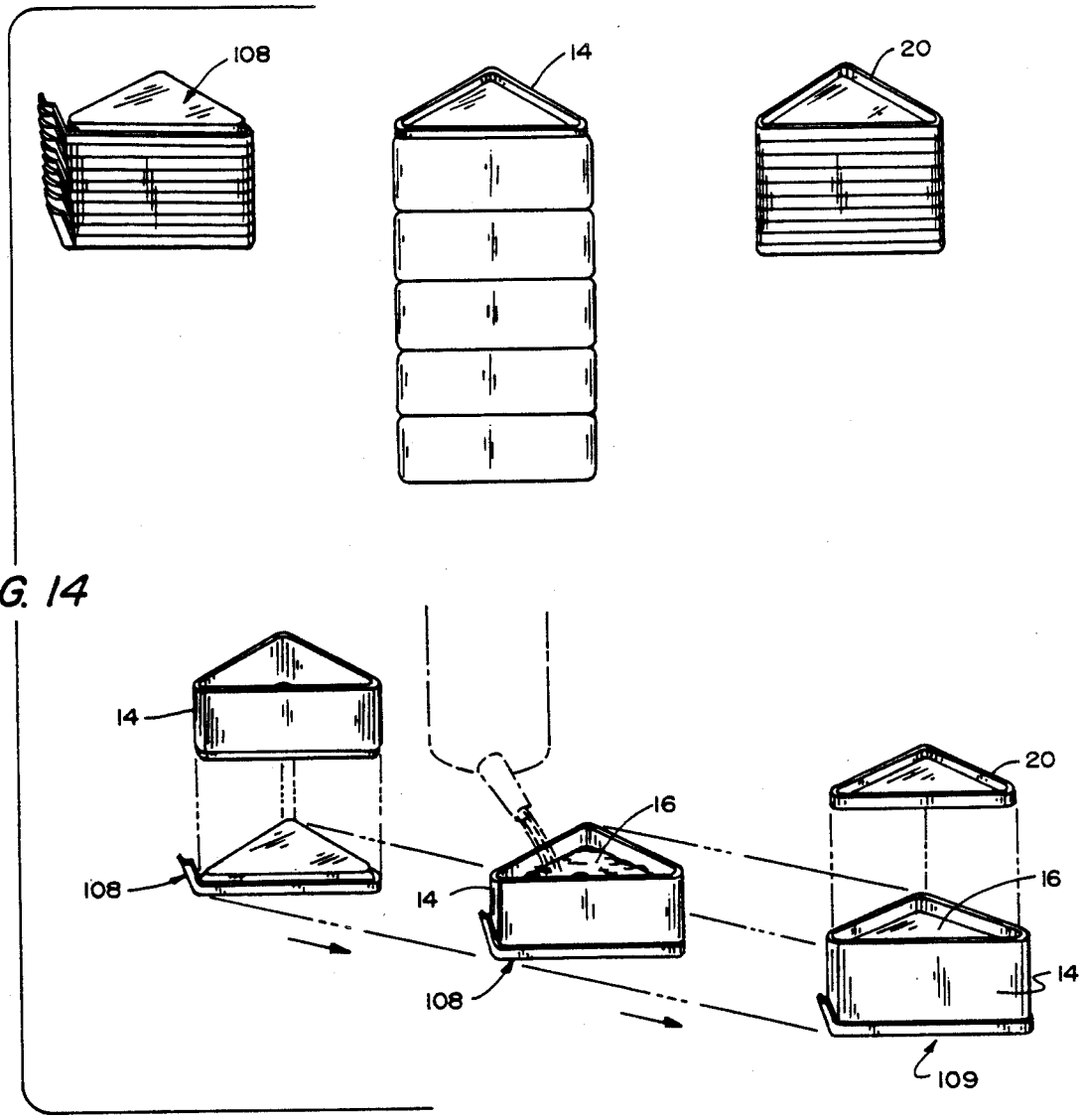
FIG. 14 is an illustration of the component elements of the container being assembled into its final configuration.

A further embodiment of the invention is disclosed in FIG. 13. According to this embodiment, score marks 106 are provided on the upper lid 18 adjacent its periphery to assist in the separation of the central portion 74 of the upper lid 18 from its peripheral portion. Such score marks 106 would extend totally around the periphery of the upper lid 18, spaced slightly interiorly of its flange 50 beneath the adhesive 90, except in that area adjacent to point 32 whereat the pull tab 82 was initially located to preclude total separation of the upper lid 18 from the sidewall 14.

In the embodiments of the invention described herein, various materials may be utilized for the upper lid 18, lower lid 20 and sidewall 14 such as sheet material formed with a barrier layer thereon, paper coated with a barrier film or other suitable state of the art materials. A clear transparent material may be utilized for the transparent section 94 to provide a transparent effect for viewing the contents 16 of the package 10.

Fragrant material 26 on the shank end 28 of the spoon 24 will transfer such fragrance to the fingers of a person consuming the contents 16 which will increase the aromatic effect.

The fragrance emitting material 26 consists of such substances as fruit peel oil or the like in absorbent media such as foam or paper which releases the fragrance when exposed to the atmosphere through the lifting of the cover 78. Alternatively, for example, aromatic gas may be encapsulated beneath the upper lid 18 and released upon removal of the upper lid 18 from the package 10. Other known suitable substances for releasing fragrances may also be utilized.

The present invention also includes the method of manufacturing or fabricating the package 10 of the present invention, the method of filling the container 12 with the edible contents 16 and the method of using the package 10. In the method of manufacturing or fabrication, the individual parts of the container 12 are preferably cut, shaped and provided at a first or primary manufacturing location with a heat activated adhesive. These parts are then stacked and shipped to various remote sites for further fabrication or assembly as well as the filling of the fabricated container 12 with the edible contents 16. At the first location or site, the sidewall 14 is initially formed by cutting the sidewall 14 material into strips which then are stacked, provided with adhesive and shipped. At the second or remote site this sidewall 14 is formed into a cylindrical configuration for receiving the upper and lower lids 18 and 20. Also at the first site, the upper and lower lids 18 and 20 are cut to shape and, like the sidewall material, are shipped with the sidewall material for assembly. The last piece formed at the first or primary site is the cover 78 which is vacuum molded to the appropriate configuration and then bonded to the upper lid 18 with a spoon 24 therebetween to form a cover-lid assembly 108. The assembly 108, like the other parts of the container 12, are shipped to the second location for assembly and filling.

Figure 15:
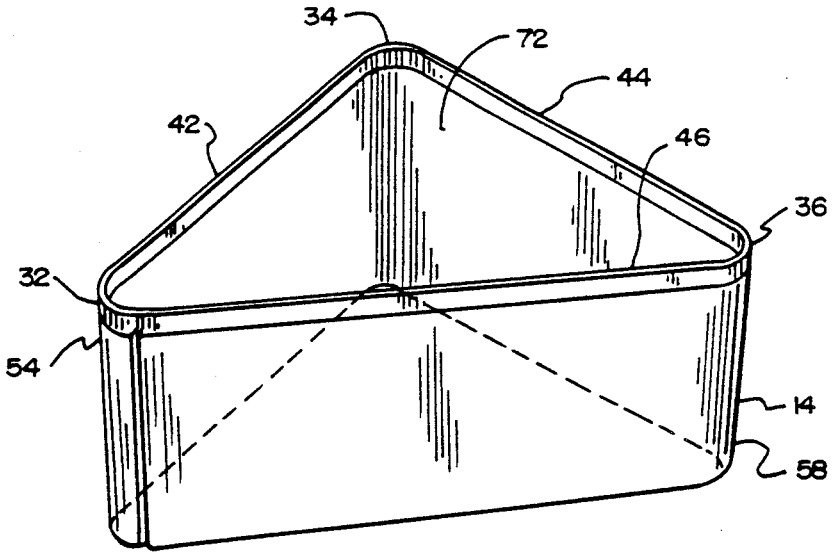
FIGS. 15 through 20 are illustrations of the package shown in FIGS. 1 through 11 but illustrating the sequential steps in its method of fabrication and filling.
Figure 16:
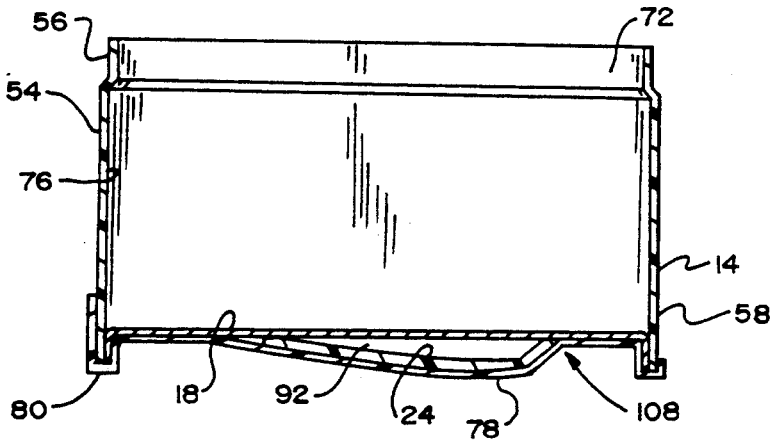

At the various second or remote sites which receive the parts of the container 12, each individual sidewall strip is provided with adhesive for being formed into a permanent cylindrical configuration. The upper lid 18 is then inserted into the upper opening 70 of the sidewall 14 in an inverted configuration whereby the lower opening 72, now facing upwardly, is filled with the edible contents 16 as will be described hereinabove. Note FIGS. 15, 16 and 17. The packages are then stacked one atop the other, with or without shrink wrapping, for shipment and subsequent use by the consumer.

The upper lid 18 is initially formed by cutting to a shape corresponding to the shape of the upper opening of the sidewall 14 but slightly larger. Its peripheral flange 80 is bent to extend perpendicularly from the flat central portion 74 of the cover 78. At the second sites, the peripheral flanges are provided with adhesive on their exterior faces and then inserted in recessed fashion into the upper opening 70 of the sidewall 14. Their exterior faces are in contact with the interior faces of the sidewall 14 adjacent to the unconstricted end.

The cover 78 is initially formed to a shape corresponding to the shape of the upper opening 70 of the sidewall 14 but with a periphery slightly smaller to fit within the recess of the upper lid 18. This is preferably effected by vacuum molding. Its peripheral flange 80 is bent to extend upwardly from its indented or troughed central portion 84. The peripheral flange 80 is provided on its exterior face with adhesive and then inserted in recessed fashion over the upper lid 18. The central portion 84 is formed in the upper lid 18 in a configuration to receive a utensil 24 such as a spoon which is located between the upper lid 18 and cover 78 prior to coupling the upper lid 18 into final position for use.

Figure 18:
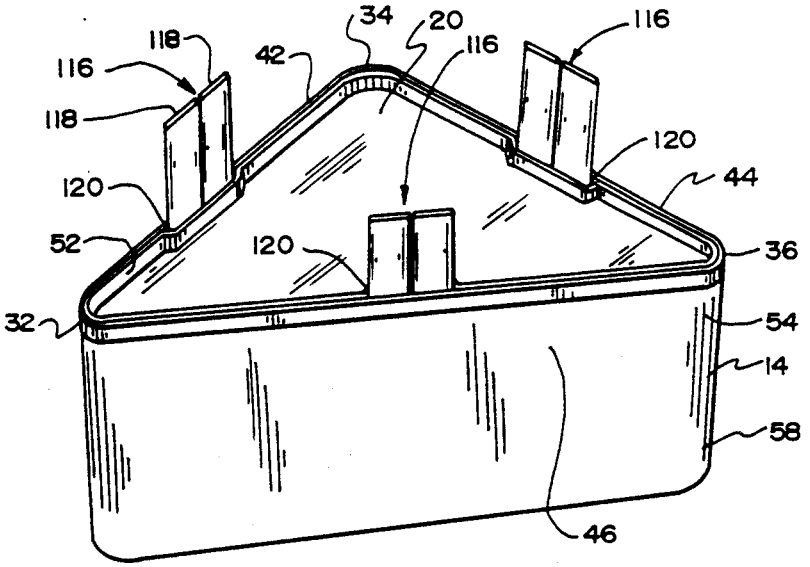
Figure 19:
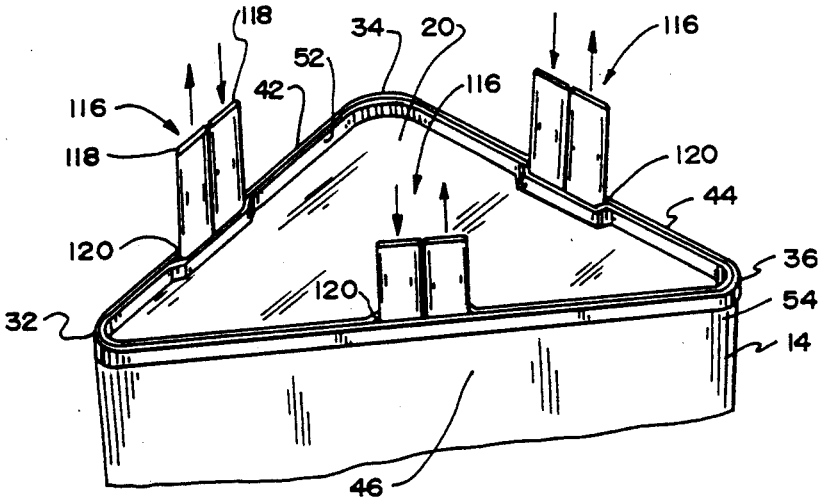
Figure 20:
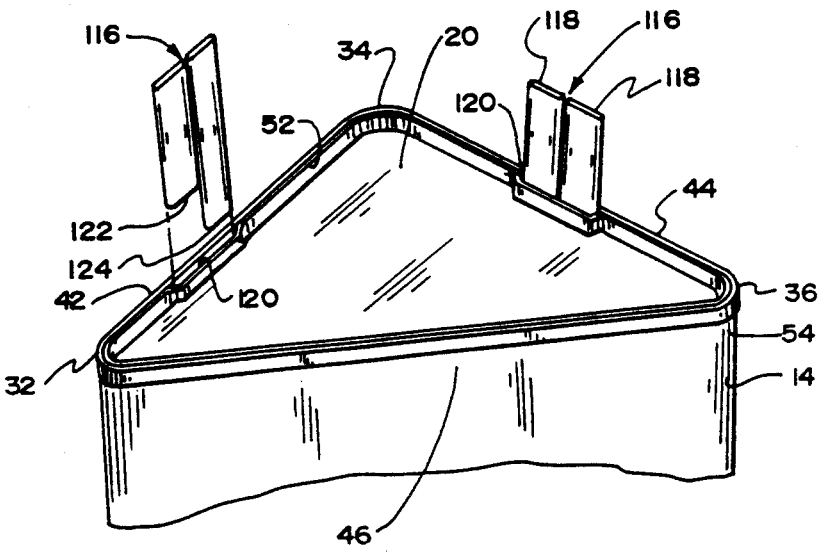

Next, the container 12 is prefilled with liquid 112 for the majority of its volume. Edible solids 110 such as citrus or other fruit segments to be packaged are then placed in the liquid 112. A plurality of nozzle pairs 116, one centrally located adjacent to each side 42, 44 and 46, are then placed within the container 12 with their upper ends 118 exposed. In a manner similar to that described with respect to the upper lid 18, the lower lid 20 is then inserted in recessed fashion into the container and sealed with adhesive 62 at all areas except at the locations 120 of the nozzle pairs 116. Note that in FIGS. 18, 19 and 20 the upper ends 118 of the nozzle pairs 116 are exposed while their lower ends 122 and 124 extend downwardly toward the fluid 112. The lower ends 124 of the longer nozzles extend well into the fluid 112 while the lower ends 122 of the shorter nozzles extend to the level of the lower lid 20 or slightly thereabove.

Fluid 112 is then injected through the longer halves of each nozzle pair 116. The fluid 112 acts to fill the container 12 completely with fluid 112 and remove the air from within the package 10 for thereby extending the shelf life of the packaged product. The shorter halves constitute suck-back nozzles since their heights are set to remove all bubbles and voids forced upwardly by the longer nozzle half and thereby bringing the fluid 112 level up to the lower lid 20. This brings the prefill level up to zero head space.

The nozzle pairs 116 are then removed, preferably one at a time, and the package 10 sealed sequentially at the nozzle opening before the next nozzle is removed.

The lower edges 66 on the sidewall 14 are then rolled over the flange 52 of the lower lids 20 to complete the finished package 10.

The packages are then stacked one atop the other, with or without shrink wrapping, for shipment and subsequent use by the consumer.

The method of opening the package 10 formed of a container 12 and edible contents 16 within the container. The container comprising a substantially cylindrical shaped sidewall 14 and an upper lid 18 and a substantially parallel lower closure 20. A cover 78 is removably mounted above the upper lid 18 to define a space 92 between the upper lid 18 and the cover 78 and a utensil 24 within the space for use in consuming the edible contents within the container. The method comprises the steps of first separating the cover 78 from a portion of the package 10. The utensil 24 is then removed from the remainder of the package 10. A portion of the upper lid 18 is then pulled away from the remainder of the package to expose the contents 16 of the package. The pulling is terminated when greater resistance to the pulling is met whereby the contents 16 will be essentially completely exposed for consumption but a portion of the upper lid 18 will remain coupled with the sidewall 14 for the precluding of littering.

The present invention having been thus described, it should be apparent that modifications could be made to the various components of the package means of the present invention, as would occur to one of ordinary skill in the art without departing from the spirit and scope of the present invention.

Now that the invention has been described,

What is claimed is:

1. A package including a container and contents for the storing and the direct consumption of edible contents therefrom comprising:

a container comprising an upstanding circumferential sidewall, a separable upper lid and an essentially parallel bottom closure; said sidewall, upper lid and bottom closure hermetically sealing edible contents contained therein;

a cover separably mounted and at least partly spaced above the upper lid to define a space between the upper lid and the cover, said cover having a grasping means for initiating separation of said cover from said upper lid; said cover being bonded to the upper lid adjacent thereto by light adhesive over a major portion of the extent of their bonding sufficient to allow for the easy separation of the cover from the upper lid adjacent thereto during opening and the cover being bonded with respect to the upper lid adjacent thereto by a stronger adhesive than said light adhesive over the remaining minor portion of the extent of their bonding remote from said grasping means sufficient to preclude total separation of the cover from the upper lid adjacent thereto during use;

a utensil within the space for use in the consuming of the edible contents stored within the container;

the upper lid being bonded by additional light adhesive to the sidewall adjacent thereto sufficient to allow for the easy separation of the upper lid with respect to the sidewall adjacent thereto over a major portion of the extent of their bonding and wherein the upper lid is bonded by additional stronger adhesive stronger than said additional light adhesive to the sidewall adjacent thereto for prohibiting the easy separation of the upper lid with respect to the sidewall adjacent thereto over the remaining minor portion of the extent of their bonding sufficient to preclude total separation of the upper lid being bonded to the upper edge of the sidewall with said additional light and said additional stronger adhesive extending around the entire periphery of the upper lid and sidewall to render such area of bonding tamper evident; said adhesives bonding said cover to said upper lid and said adhesives bonding said upper lid to said side wall providing an air tight seal for said utensil and said contents, respectively; said minor portion of said bond between said upper lid and said side wall being remote from said minor portion of said bond between said cover and said upper lid and positioned under and approximately adjacent said grasping means and said adhesives and additional adhesives selected, and said minor portion of said bond between said cover and said upper lid being stronger than said major portion of the bond between said upper lid and said sidewall such that upward pulling on said grasping means breaks the bond between said cover and said upper lid until said minor portion of stronger bonding between said cover and said upper lid is reached whereupon said utensil is exposed, and further separation of said cover from the upper lid is precluded and such that continued upward pulling of said grasping means breaks the bond between said upper lid and said sidewall until said minor portion of stronger bonding between said upper lid and said side wall is reached, whereupon the contents are exposed and total separation of the upper lid from the side wall is precluded, thus causing the cover and upper lid and the upper lid and side wall, respectively, to remain partially bonded to each other.

2. The package as set forth in claim 1 and further including means between the upper lid and the cover for emitting a fragrance upon the separation of the cover from the upper lid.

3. The package as set forth in claim 1 wherein the sidewall adjacent said bottom closure is constricted to a reduced size for being inserted within the opposite end of another container.

4. The package as set forth in claim 1 wherein the container is essentially triangular in top plan view.

* * * * *